US007612669B2

(12) United States Patent
Brigham

(10) Patent No.: US 7,612,669 B2
(45) Date of Patent: Nov. 3, 2009

(54) BOLT FOR SECURITY SEAL

(75) Inventor: Kristin Brigham, San Francisco, CA (US)

(73) Assignee: Savi Technology, Inc., Mountain View, CA (US)

( * ) Notice: Subject to any disclaimer, the term of this patent is extended or adjusted under 35 U.S.C. 154(b) by 293 days.

(21) Appl. No.: 11/773,507

(22) Filed: Jul. 5, 2007

(65) Prior Publication Data

US 2009/0009328 A1 Jan. 8, 2009

Related U.S. Application Data

(60) Provisional application No. 60/844,238, filed on Sep. 13, 2006.

(51) Int. Cl.
*G08B 13/12* (2006.01)

(52) U.S. Cl. ..... 340/568.4; 340/540; 70/9; 70/57.1

(58) Field of Classification Search ..... 340/568.4, 340/568.1, 542; 70/9, 91, 50, 57.1
See application file for complete search history.

(56) References Cited

U.S. PATENT DOCUMENTS 5,056,837 A * 10/1991 Fuehrer ..... 292/307 R
5,892,181 A * 4/1999 Takahashi ..... 177/136
6,069,563 A * 5/2000 Kadner et al. ..... 340/571
6,265,973 B1 * 7/2001 Brammall et al. ..... 340/568.1
6,407,666 B1 6/2002 Debrody et al.
6,550,829 B1 * 4/2003 Dobson ..... 292/327

* cited by examiner

*Primary Examiner*—Davetta W Goins
*Assistant Examiner*—Edny Labbees
(74) *Attorney, Agent, or Firm*—Haynes and Boone, LLP

(57) ABSTRACT

A seal bolt includes: an elongate and electrically conductive part with a portion extending between first and second locations lengthwise of the bolt; an electrically conductive layer that, between the first and second locations, is spaced from the elongate part; an electrically insulating layer that, between the first and second locations, is disposed between the conductive layer and the elongate part; and structure that electrically couples the elongate part and the conductive layer at a third location, the second location being between the first and third locations. In one configuration, the insulating layer includes aluminum oxide. In another configuration, the conductive layer is one of an amorphous metal and stainless steel. In still another configuration, the conductive layer includes a strip that, from the first location to the second location, has a width less than a circumference of the elongate part.

28 Claims, 5 Drawing Sheets

BOLT FOR SECURITY SEAL

This application claims the priority under 35 U.S.C. § 119 of provisional application No. 60/844,238 filed Sep. 13, 2006.

FIELD OF THE INVENTION

This invention relates in general to security seals of a type that can be used with cargo containers and, more particularly, to security bolts that are components of certain security seals.

BACKGROUND

A variety of different products are shipped in cargo containers. Products are typically packed into the container by a shipper, and then the container doors are closed and secured. The container is then transported to a destination, where a recipient opens the container and unloads the products.

The shipper often finds it desirable to have some form of security and/or monitoring in place while the container is being transported. For example, the cargo within the container may include relatively valuable products, such as computers or other electronic devices. Thieves may thus attempt to break into the container and steal these products if the container is left unattended during transport. It is not cost-feasible to achieve suitable security and/or monitoring by having a person watch the container at all times during transport. Accordingly, various devices have previously been developed to provide some degree of security and/or monitoring. Although these pre-existing devices have been generally adequate for their intended purposes, they have not been satisfactory in all respects.

For example, one pre-existing container security device is commonly referred to as a bolt seal. It includes an elongate bolt or pin with a head at one end. The bolt is inserted through aligned openings in a latch mechanism on the container doors, and then the free end of the bolt is inserted into a retaining assembly. The retaining assembly mechanically and permanently grips the bolt, so that the bolt cannot be withdrawn. The bolt has an electrically conductive core and an electrically conductive sleeve that are separated by an electrically insulating layer, except that the core and sleeve are in an electrical contact in the region of the head of the bolt. The retaining assembly has a circuit with two electrical contacts that respectively engage the conductive core and the conductive sleeve. Since the core and sleeve are electrically shorted at the head of the bolt, the two contacts of the circuit are also electrically shorted during normal operation.

If a thief cuts the bolt at a location between the head and the retaining assembly, the removal of the head eliminates the internal electrical short between the conductive core and the conductive sleeve. Since the core and the sleeve are no longer shorted, the contacts of the circuit are also no longer shorted, and thus the circuit can tell that someone has tampered with the bolt. The circuit can optionally include a radio transmitter, and the radio transmitter can then transmit a wireless signal indicating that the circuit has detected tampering.

In practice, devices of this type do not always operate in this intended manner. As one example, pre-existing bolts often have a conductive sleeve made from nickel, which is a relatively soft material. When a thief cuts the bolt, the jaws of the bolt cutter can smear the nickel material in a radially inward direction as the cut is made. When this smear occurs, it creates an electrical short between the conductive sleeve and the conductive core. Thus, even though the original internal short is eliminated with the removal of the bolt head, it is effectively replaced by an equivalent short in the form of the nickel smear. Due to this new short, the contacts of the circuit in the retaining assembly remain electrically shorted. Consequently, the circuit does not detect the fact that tampering has occurred, and does not take appropriate action.

In terms of testing a bolt configuration, several bolts with that configuration may each be subjected to a "loose cargo test" conforming to a well-known standard defined by MIL-STD 310F, and then a bolt cutting test of the type discussed above. Pre-existing bolt configurations tend to fail rapidly in the loose cargo test, without ever making it as far as the bolt cutting test.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 3:
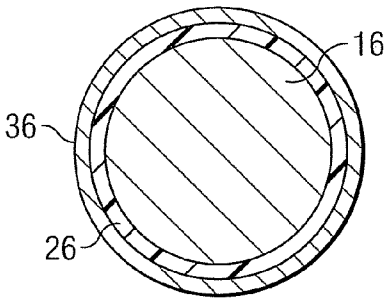
FIG. 3 is a diagrammatic sectional view taken along the section line 3-3 in FIG. 2.
Figure 1:
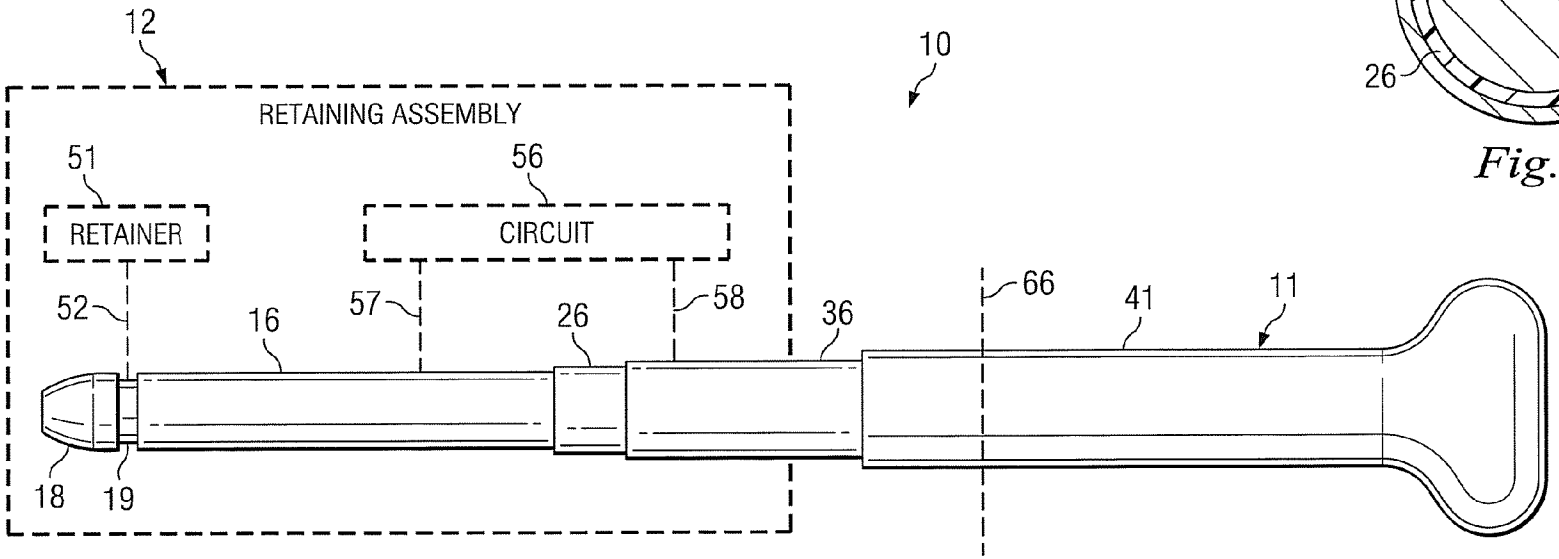
FIG. 1 is a diagrammatic top view of an apparatus in the form of a container security device that includes a security bolt embodying aspects of the invention.
Figure 2:
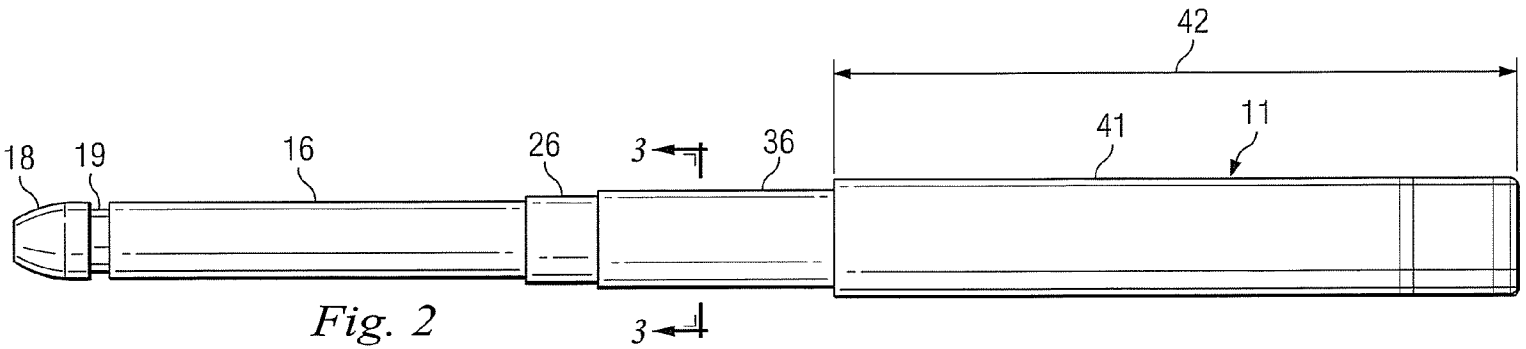
FIG. 2 is a diagrammatic side view of the security bolt of FIG. 1.

FIG. 1 is a diagrammatic top view of an apparatus 10 that is a container security device. Devices of this general type are often referred to as bolt seals. The apparatus 10 includes a security bolt 11 that embodies aspects of the invention, and a known type of retaining assembly 12 that is shown in broken lines. FIG. 2 is a diagrammatic side view of the bolt 11 of FIG. 1. FIG. 3 is a diagrammatic sectional view of the bolt 11, taken along the line 3-3 in FIG. 2. The drawings of the present application are not drawn to scale in all respects. As one example, the thicknesses of some layers have been exaggerated for clarity.

Figure 4:
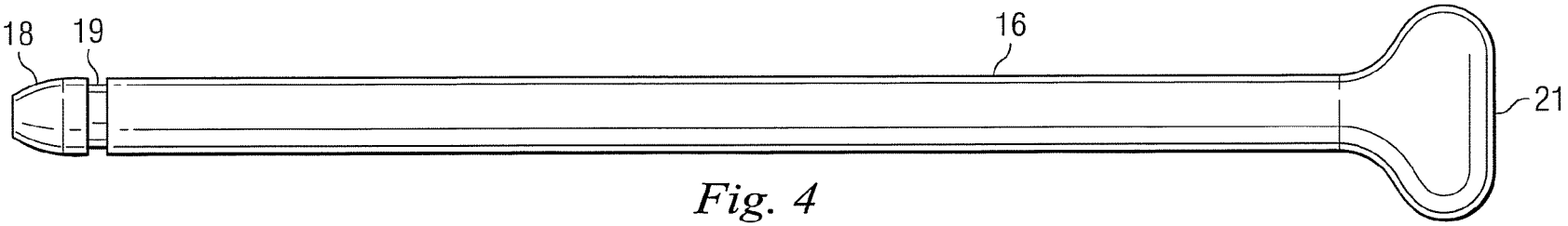
FIG. 4 is a diagrammatic top view of a pin that is a component of the bolt of FIG. 1.
Figure 5:
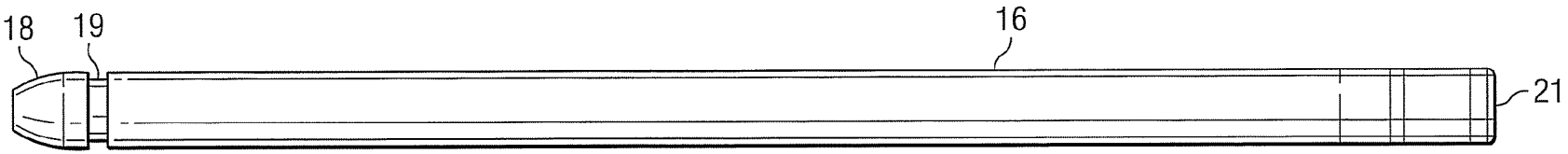
FIG. 5 is a diagrammatic side view of the pin of FIG. 4.

Referring to FIGS. 1-3, the bolt 11 has at its center an elongate, electrically conductive pin 16. FIG. 4 is a diagrammatic top view the pin 16 by itself, and FIG. 5 is a diagrammatic side view of the pin 16. In the disclosed embodiment, the pin 16 is made of steel. However, it could alternatively be made of any other suitable material. The pin 16 is cylindrical along most of its length, except at each end. At one end, the pin 16 has an optional tapered surface 18 of approximately frustoconical shape. The tapered surface 18 facilitates insertion of the bolt 11 into the retaining assembly 12 (FIG. 1). Near the tapered surface 18, the pin 16 has a circumferential groove 19.

At its opposite end, the pin 16 has a flattened head 21. With reference to FIG. 4, the head 21 has approximately an oval shape in a top view, with a length that is greater than the diameter of the remainder of the pin 16. With reference to FIG. 5, the head 21 is generally flat in a side view, with a thickness that is approximately equal to the diameter of the pin 16. The shape of the head 21 in FIGS. 4 and 5 is exemplary, and the head 21 could alternatively have any of a variety of other shapes. Although the illustrated pin 16 is generally cylindrical between its ends, it could alternatively have any of a variety of other cross-sectional shapes.

Figure 6:
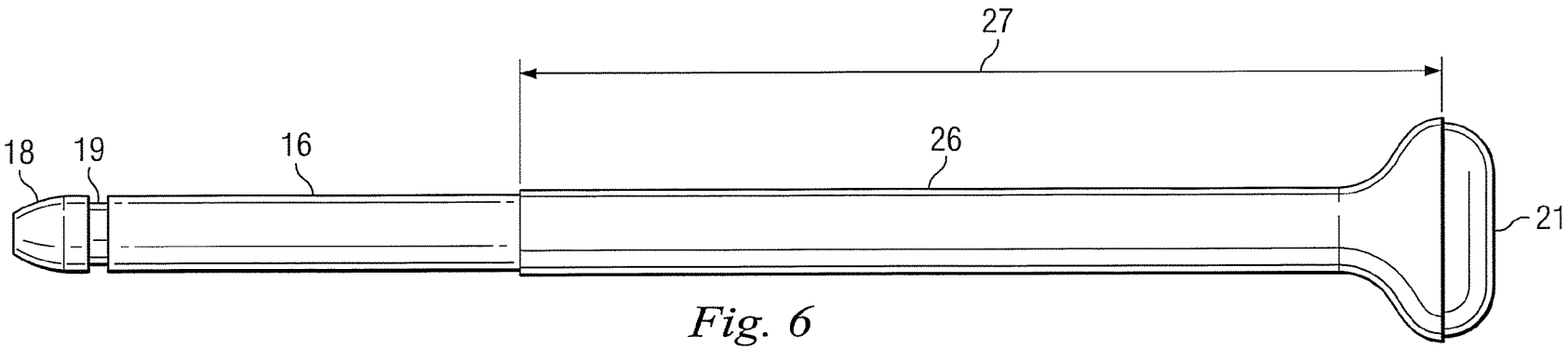
FIG. 6 is a diagrammatic top view of the pin of FIG. 4, with the addition of an insulating layer.

Referring again to FIGS. 1 and 2, the pin 16 is coated over a portion of its length with a layer 26 of an electrically insulating material. FIG. 6 is a diagrammatic top view of the pin 16 with the insulating layer 26 thereon. The insulating layer 26 completely coats the exterior surface of the pin 16 within the region indicated at 27. It will be noted that the outer end of the head 21 is not coated with the insulating layer 26. The insulating layer 26 is, in effect, a sleeve that surrounds the pin 16 over a portion 27 of its length. In the disclosed embodiment, the insulating layer 26 is made from aluminum oxide, also known as alumina. However, in an alternative embodiment, the insulating layer 26 could be made from some other suitable material that is electrically insulating.

Figure 7:
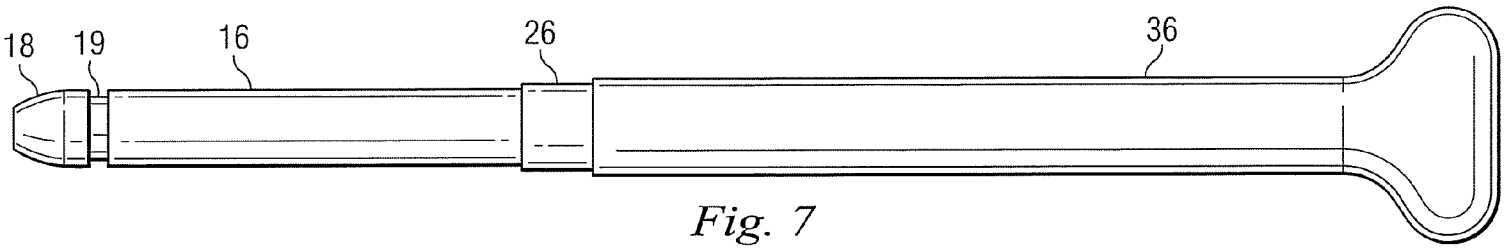
FIG. 7 is a diagrammatic top view of the pin and insulating layer of FIG. 6.
Figure 8:
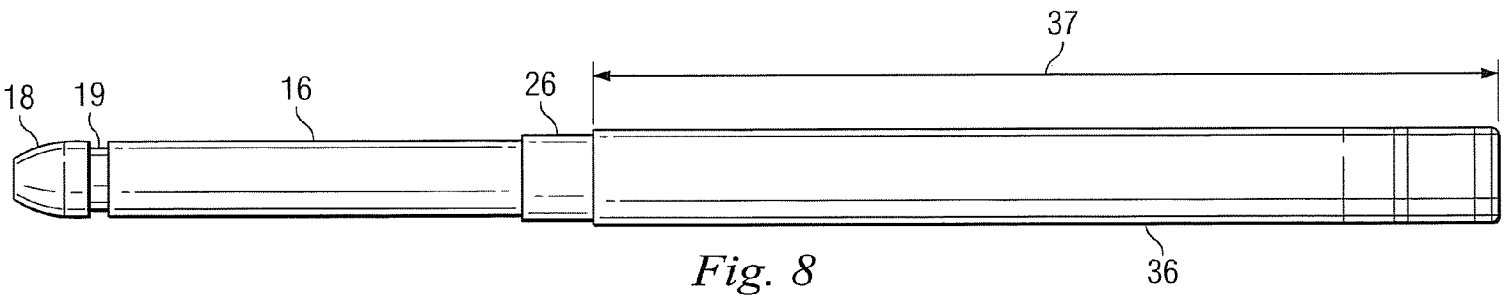
FIG. 8 is a diagrammatic side view of the pin and insulating layer of FIG. 6, with the addition of a conductive layer.

Referring again to FIGS. 1 and 2, an electrically conductive layer 36 is provided over part of the insulating layer 26. FIG. 7 is a diagrammatic top view of the pin 16, insulating layer 26, and conductive layer 36. FIG. 8 is a diagrammatic side view of the pin 16, insulating layer 26, and conductive layer 36. The conductive layer 36 coats all exposed surfaces of the insulating layer 26 and the pin 16 in a region of the bolt that is identified at 37. As shown in FIGS. 7 and 8, the insulating layer 26 extends leftwardly a short distance beyond the end of the conductive layer 36. As shown in FIG. 6, and as discussed above, the head 21 has a portion that is not coated by the insulating layer 26. Thus, with reference to FIGS. 7 and 8, it will be recognized that, at the outer end of the head 21, the conductive layer 36 is in direct physical contact with the conductive pin 16. The remainder of the conductive layer 36 is electrically separated from the pin 16 by the insulating layer 26.

In the illustrated embodiment, the conductive layer 36 is an amorphous metal material that includes iron, chromium, silicon and boron. As one example, the conductive layer 26 may include 26% to 31% chromium, 1.2% to 2.7% silicon, and 3.3% to 4.1% boron, with the remainder being iron. One suitable material for the conductive layer 26 can be obtained commercially under the trademark ARMACOR M® from Liquidmetal Technologies Corporation of Lake Forest, Calif. However, the conductive coating 36 could alternatively be made from other suitable materials, including but not limited to stainless steel or nickel. ARMACOR M® and stainless steel are not as soft as nickel, and are thus less likely to smear radially when a bolt is cut. As still another alternative, the conductive layer 36 could be made from a conductive epoxy or a conductive polymer, either of which could be applied by spraying at room temperature.

Referring again to FIGS. 1 and 2, the exterior surfaces of the conductive layer 36 are completely coated with an electrically insulating outer layer 41 in a region of the bolt 11 that is identified at 42. The outer layer 41 can be made from any of a variety of electrically insulating materials that are known in the art.

Referring again to FIG. 1, the retaining assembly 12 includes a retainer mechanism that is shown diagrammatically at 51, and that includes a spring clip 52. When the free end of the bolt 11 has been fully inserted into the retaining assembly 12, the spring clip 52 engages the circumferential groove 19 in the pin 16, in order to permanently secure the bolt 11 within the retaining assembly 12, so that the bolt cannot be withdrawn.

The retaining assembly 12 also includes a circuit 56 with two spaced electrical contacts 57 and 58. When the end of the bolt 11 is disposed in the retaining assembly 12, and is fixedly held in place by the retainer mechanism 51, the electrical contact 57 engages the exposed surface of conductive pin 16, and the electrical contact 58 engages the exposed surface of conductive layer 36. As explained above, the head of the bolt 11 contains an electrical short between the pin 16 and the conductive layer 36. Thus, during normal operation, the electrical contacts 57 and 58 will be shorted to each other by the bolt. Assume that a thief cuts the bolt 11, for example at a location 66 between the retaining assembly 12 and the head of the bolt. When the thief cuts the bolt, the head of the bolt becomes separated from the rest of the bolt, thereby eliminating the internal short between the pin 16 and the conductive layer 36. Consequently, the electrical contacts 57 and 58 will no longer be electrically shorted by the bolt. The circuit 56 can thus detect that the bolt 11 had been cut. The circuit 56 then could, for example, transmit a wireless signal indicating that the security device 10 has apparently been subjected to some form of tampering.

Figure 9:
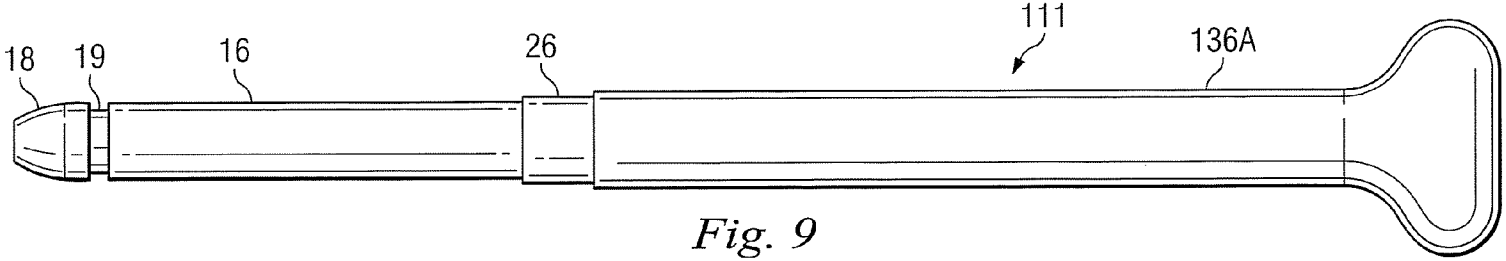
FIG. 9 is a diagrammatic top view of a further security bolt that is an alternative embodiment of the bolt of FIG. 1.
Figure 10:
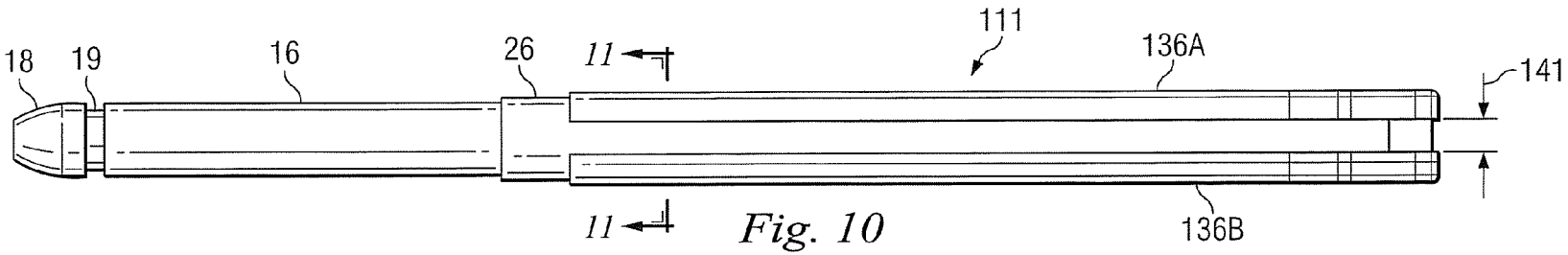
FIG. 10 is a diagrammatic side view of the bolt of FIG. 9.
Figure 11:
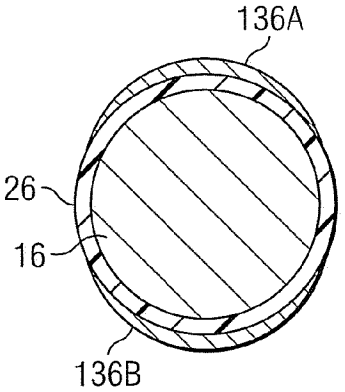
FIG. 11 is a diagrammatic sectional view taken along the section line 11-11 in FIG. 10.

FIG. 9 is a diagrammatic top view of a bolt 111 that is an alternative embodiment of the bolt 11 of FIG. 1. FIG. 10 is a diagrammatic side view of the bolt 111, and FIG. 11 is a diagrammatic sectional view taken along the section line 11-11 in FIG. 10. The bolt 111 includes an outer layer equivalent to that shown at 41 in FIG. 1, but the outer layer is omitted in FIGS. 9-11 for clarity. The bolt 111 of FIGS. 9-11 is identical to the bolt 11 of FIG. 1, with one difference. In particular, with reference to FIG. 8, the conductive layer 36 of the bolt 11 covers all underlying surfaces in the region 37. In contrast, with reference to FIGS. 9-11, the bolt 111 has two conductive layers 136A and 136B instead of the single conductive layer 36. The two conductive layers 136A and 136B are provided on opposite sides of the bolt 111, as best seen in FIGS. 10 and 11. The edges of the conductive layer 136A are thus spaced circumferentially from the edges of the conductive layer 136B by a gap 141 (FIG. 10). The conductive layers 136A and 136B can be made from any of the same materials discussed above in association with the conductive layer 36 of the bolt 11.

With reference to FIGS. 10 and 11, it will be noted that the conductive layers 136A and 136B include respective strips of electrically conductive material that each extend lengthwise of the bolt 111, and that are spaced circumferentially from each other. As best seen in FIG. 11, these strips are each thicker in the middle than at the edges. Although the bolt 111 of FIGS. 9-11 has two of these strips, it would alternatively be possible to provide only one such strip, or to provide three or more strips that are circumferentially spaced and that extend lengthwise of the bolt. It will also be noted that the strips 136A and 136B each extend straight along the bolt 11, parallel to the centerline of the bolt. However, these strips could alternatively be arranged in various other configurations. For example, the strips could be arranged so that they each extend along and around the bolt in a spiral, while still remaining circumferentially spaced from each other.

Figure 12:
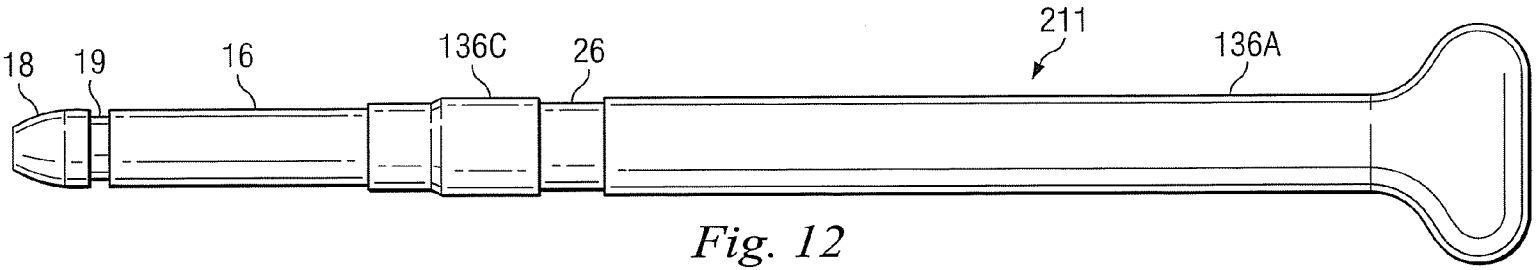
FIG. 12 is a diagrammatic top view of a further security bolt that is an alternative embodiment of the bolt of FIGS. 9-11.
Figure 13:
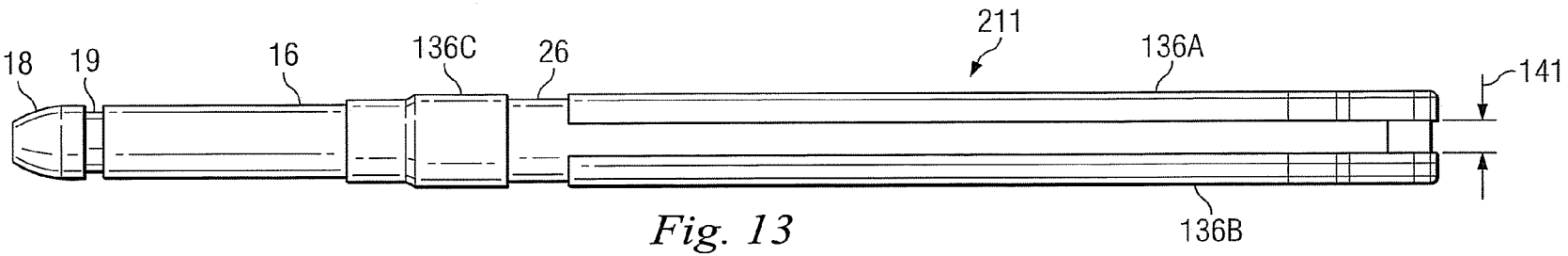
FIG. 13 is a diagrammatic side view of the bolt of FIG. 12.

FIG. 12 is a diagrammatic top view of a bolt 211 that is an alternative embodiment of the bolt 111 of FIGS. 9-11. FIG. 13 is a diagrammatic side view of the bolt 211. The bolt 211 of FIGS. 12-13 is identical to the bolt 111 of FIGS. 9-11, except that the conductive layer includes not only the portions 136A and 136B, but also an additional portion 136C that is spaced axially from the portions 136A and 136B, and that has one portion disposed on the insulating layer 26 and another portion disposed on the pin 16.

Figure 14:
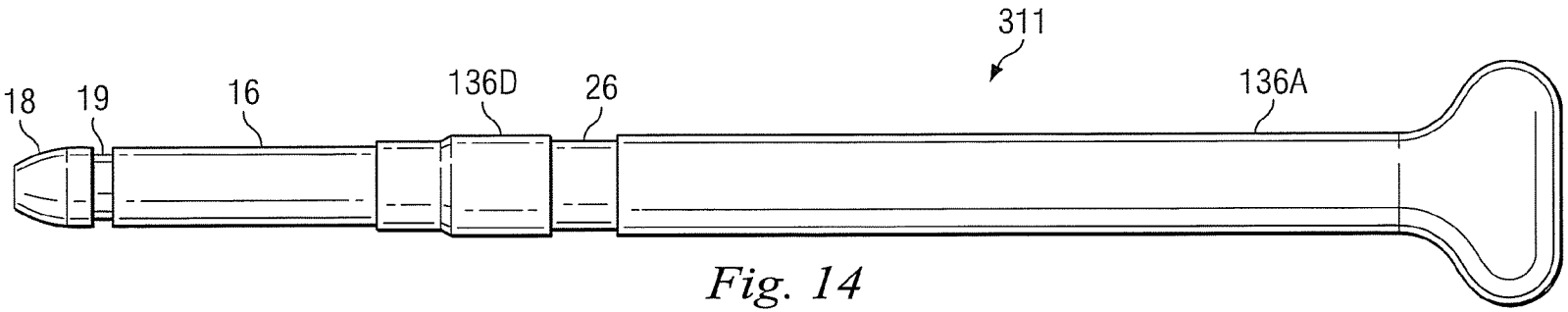
FIG. 14 is a diagrammatic top view of still another security bolt that is an alternative embodiment of the security bolt of FIGS. 12-13.
Figure 15:
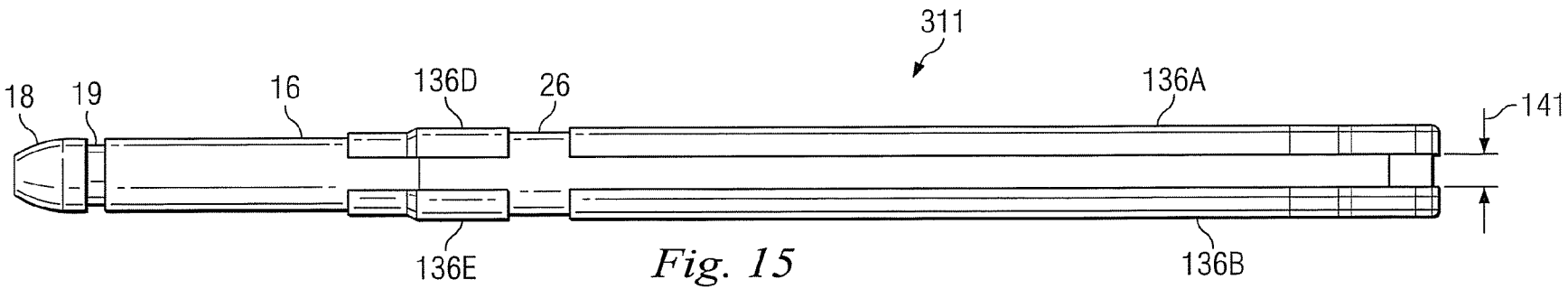
FIG. 15 is a diagrammatic side view of the bolt of FIG. 14.

FIG. 14 is a diagrammatic top view of a bolt 311 that is an alternative embodiment of the bolt 211 of FIGS. 12-13. FIG. 15 is a diagrammatic side view of the bolt 311. The bolt 311 of FIGS. 14-15 is identical to the bolt 211 of FIGS. 12-13, except that the conductive sleeve 136C of the bolt 211 is split into two conductive strips 136D and 136E that are disposed on opposite sides of the bolt 311, with their lateral edges spaced by the gap 141.

A number of bolts were built and tested, using different configurations and materials for the conductive layer 36 or 136, and different thicknesses for the aluminum oxide insulating layer 26. Several bolts of each configuration were initially subjected to a "loose cargo test" that conformed to a well-known standard defined by MIL-STD 310F. A bolt configuration was deemed to have passed the loose cargo test if all of the tested bolts with that configuration passed the loose cargo test. Table 1 below identifies 16 bolt configurations that all passed the loose cargo test, where each row of the table represents a respective different bolt configuration. Table 1 summarizes additional testing that was carried out on each of these bolt configurations, in the form of a bolt cutting test that tests bolts for a false tamper signal, or in other words an undesired electrical short.

In more detail, for each bolt configuration in Table 1, 25 to 50 bolts with that configuration were subjected to the bolt cutting test. In particular, standard bolt cutters were used to cut each bolt approximately at location 66 in FIG. 1, and then a measurement was taken of the electrical resistance between the conductive pin 16 and each conductive layer 36 or 136, at locations where the bolt would typically be engaged by the electrical contacts 57 and 58. If a bolt exhibited a relatively high resistance that effectively represented an open circuit, then that particular bolt was deemed to have passed the bolt cutting test. Conversely, if a bolt exhibited a relatively low resistance that effectively represented an electrical short, then that particular bolt was deemed to have failed the bolt cutting test. For a given configuration/row in Table 1, if 100% of the tested bolts with that configuration each passed the bolt cutting test, then that configuration was deemed to have passed the bolt cutting test. Conversely, if just one of the tested bolts with that configuration failed the bolt cutting test, then that configuration was deemed to have failed the bolt cutting test.

Turning now in more detail to Table 1, bolt configurations 1-6 all involve an aluminum oxide insulating layer 26 with a thickness of approximately 0.025 inches. The bolts in configurations 1, 3 and 5 each had a conductive layer configured as multiple strips, for example as shown at 136A and 136B in FIGS. 9-11. The materials used for the conductive layers 136A and 136B in these three configurations were respectively ARMACOR M®, 400 stainless steel (400 SS), and nickel. The bolts in configurations 2, 4 and 6 had a continuous conductive layer rather than strips, for example as shown at 36 in FIG. 7-8. The materials used for the conductive layers 36 in these three configurations were respectively ARMACOR M®, 400 stainless steel (400 SS), and nickel. As evident from Table 1, all of the bolts in each of configurations 1-6 passed the bolt cutting test.

During fabrication of bolts, the aluminum oxide insulating layer 26 is formed by a plasma process. The larger the thickness of the insulating layer, the longer the plasma process must be performed in order to produce that thickness. The plasma process uses a significant amount of energy, due in part to the fact that it is performed at a high temperature, and due in part to the energy needed to form the plasma. Consequently, with reference to bolt configurations 1-6 in Table 1, an insulating layer 26 with a thickness of a 0.025 inches is relatively expensive, because of the amount of energy required to produce that thickness. Accordingly, while the bolts in configurations 1-6 all exhibit excellent performance in both the loose cargo test and the bolt cutting test, it is desirable to consider whether their cost could be reduced by reducing the thickness of the aluminum oxide insulating layer 26.

Accordingly, in Table 1, bolt configurations 7-12 are respectively identical to configurations 1-6, except that the thickness of the aluminum oxide insulating layer 26 was 0.012 inches, or in other words about half of the thickness used for bolt configurations 1-6. As shown in Table 1, configurations 7 and 8 each involved bolts with a conductive layer 36 or 136 made of ARMACOR M®, and all bolts with configurations 7 and 8 passed the bolt cutting test. Further, bolt configurations 9 and 11 involved bolts with the conductive layer made of 410 stainless steel or nickel and configured as multiple strips 136A and 136B, and all bolts with configurations 9 and 11 passed the bolt cutting test. However, as to bolt configurations 10 and 12, where the conductive layer was made of 410 stainless steel or nickel, and was a continuous layer 36 rather than strips 136A and 136B, some bolts with each of these configurations did not pass the bolt cutting test.

As discussed above, the cost of the aluminum oxide insulating layer 26 increases progressively with increasing thickness. Accordingly, in Table 1, bolt configurations 13-16 are respectively identical to configurations 1-3 and 5, except that the thickness of the aluminum oxide insulating layer 26 was 0.006 inches, or in other words about one-quarter the thickness used for bolt configurations 1-6, and about one-half the thickness used for bolt configurations 7-12. As evident from Table 1, the bolts with configuration 13 all passed the bolt cutting test, in particular where the conductive layer was made of ARMACOR M® and formed as strips (as at 136A and 136B in FIGS. 9-11). On the other hand, as to the bolts with configuration 14, where the conductive layer was made of ARMACOR M® and was continuous (as at 36 in FIGS. 7-8), at least one bolt with this configurations did not pass the bolt cutting test. Bolt configurations 15 and 16 each had a conductive layer arranged as strips 136A and 136B made of either 410 stainless steel or nickel, and at least one bolt in each of these configurations did not pass the bolt cutting test.

The bolts in configurations 13 and 14 satisfactorily passed both the loose cargo test and the bolt cutting test, and also have the thinnest layers of aluminum oxide. Thus, they involve the lowest cost for fabricating the aluminum oxide layer 26. On the other hand, configurations 13 and 14 use ARMACOR M®, which is a relatively expensive material in comparison to either stainless steel or nickel. Depending on factors such as production quantities, the differential cost of using ARMACOR M® instead of stainless steel or nickel can exceed the differential cost of forming 0.012 inches of aluminum oxide, rather than just 0.006 inches. Thus, for applications where it is important to minimize cost, configurations 9 and 11 may provide suitable performance at the lowest overall cost. Conversely, where cost reduction is not a primary goal, other configurations may represent appropriate choices, for example any of the configurations 1-2, 7-8 and 13-14 that utilize ARMACOR M®.

TABLE 1

| BOLT CONFIGURATION | $Al_2O_3$ LAYER 26 (THICKNESS) | CONDUCTIVE LAYER 36, 136 (THICKNESS 0.002" to 0.003") MATERIAL | CONFIGURATION | RESULT |
|---|---|---|---|---|
| 1 | 0.025" | ARMACOR M ® | Strips | Pass |
| 2 | | ARMACOR M ® | Continuous | Pass |
| 3 | | 400 SS | Strips | Pass |
| 4 | | 400 SS | Continuous | Pass |
| 5 | | Nickel | Strips | Pass |
| 6 | | Nickel | Continuous | Pass |
| 7 | 0.012" | ARMACOR M ® | Strips | Pass |
| 8 | | ARMACOR M ® | Continuous | Pass |
| 9 | | 410 SS | Strips | Pass |
| 10 | | 410 SS | Continuous | Fail |
| 11 | | Nickel | Strips | Pass |
| 12 | | Nickel | Continuous | Fail |
| 13 | 0.006" | ARMACOR M ® | Strips | Pass |
| 14 | | ARMACOR M ® | Continuous | Fail |
| 15 | | 410 SS | Strips | Fail |
| 16 | | Nickel | Strips | Fail |

Although selected embodiments have been illustrated and described in detail, it should be understood that a variety of substitutions and alterations are possible without departing from the spirit and scope of the present invention, as defined by the claims that follow.

What is claimed is:

1. An apparatus comprising a seal bolt that includes:

an electrically conductive elongate part having a portion extending between first and second locations on said bolt that are spaced in a direction lengthwise of said elongate part;

an electrically conductive layer that, between said first and second locations, is spaced from said elongate part and includes a strip extending along said elongate part from said first location to said second location, wherein at each point along the length of said strip from said first location to said second location said strip has a width in a direction circumferentially of said elongate part that is substantially less than a circumference of said elongate part at that point;

an electrically insulating layer, wherein between said first and second locations said insulating layer is disposed between said conductive layer and said elongate part; and structure that electrically couples said elongate part and said conductive layer at a third location, said second location being between said first and third locations in the direction lengthwise of said elongate part.

2. An apparatus according to claim 1, wherein said electrically conductive layer includes a further strip that extends along said elongate part from said first location to said second location, said strips being circumferentially spaced from each other, and being substantially free of electrical contact with each other between said first and second locations.

3. An apparatus according to claim 1, wherein said insulating layer is aluminum oxide.

4. An apparatus according to claim 3, wherein said electrically conductive layer is one of an amorphous metal, stainless steel, and nickel.

5. An apparatus according to claim 4, wherein said amorphous metal includes iron, chromium, silicon and boron.

6. An apparatus according to claim 4, wherein between said first and second locations said insulating layer has a thickness that is at least approximately 0.012 inches.

7. An apparatus according to claim 4, wherein between said first and second locations said insulating layer has a thickness that is at least approximately 0.006 inches; and wherein said electrically conductive layer is said amorphous metal.

8. An apparatus according to claim 1, wherein said insulating layer is sleevelike between said first and second locations.

9. An apparatus according to claim 8, wherein between said first and second locations: said elongate part has a first surface portion that is approximately cylindrical and that engages said insulating layer; and wherein said insulating layer is approximately cylindrical and has a second surface portion, said second surface portion being approximately cylindrical and engaging said conductive layer.

10. An apparatus according to claim 1, wherein said structure that electrically couples said elongate part and said conductive layer includes said conductive layer having a portion that engages said elongate part at said third location.

11. An apparatus comprising a seal bolt that includes:

an electrically conductive elongate part having a portion extending between first and second locations on said bolt that are spaced in a direction lengthwise of said elongate part;

an electrically conductive layer that, between said first and second locations, is spaced from said elongate part;

an electrically insulating layer, wherein between said first and second locations said insulating layer is disposed between said conductive layer and said elongate part, said insulating layer including aluminum oxide; and structure that electrically couples said elongate part and said conductive layer at a third location, said second location being between said first and third locations in the direction lengthwise of said elongate part.

12. An apparatus according to claim 11, wherein said electrically conductive layer is one of an amorphous metal, stainless steel, and nickel.

13. An apparatus according to claim 12, wherein between said first and second locations, said insulating layer has a thickness that is at least approximately 0.025 inches.

14. An apparatus according to claim 12, wherein between said first and second locations said insulating layer has a thickness that is at least approximately 0.012 inches; and wherein said electrically conductive layer is one of said amorphous metal and stainless steel.

15. An apparatus according to claim 12, wherein between said first and second locations said insulating layer has a thickness that is at least approximately 0.006 inches; and wherein said electrically conductive layer is said amorphous metal.

16. An apparatus according to claim 12, wherein said amorphous metal includes iron, chromium, silicon and boron.

17. An apparatus according to claim 11, wherein said insulating layer is sleevelike between said first and second locations.

18. An apparatus according to claim 17, wherein said conductive layer is sleevelike between said first and second locations.

19. An apparatus according to claim 17, wherein between said first and second locations: said elongate part has a first surface portion that is approximately cylindrical and that engages said insulating layer; and wherein said insulating layer is approximately cylindrical and has a second surface portion, said second surface portion being approximately cylindrical and engaging said conductive layer.

20. An apparatus according to claim 11, wherein said structure that electrically couples said elongate part and said conductive layer includes said conductive layer having a portion that engages said elongate part at said third location.

21. An apparatus comprising a seal bolt that includes:

an electrically conductive elongate part having a portion extending between first and second locations on said bolt that are spaced in a direction lengthwise of said elongate part;

an electrically conductive layer that, between said first and second locations, is spaced from said elongate part, said electrically conductive layer being one of an amorphous metal and stainless steel;

an electrically insulating layer, wherein between said first and second locations said insulating layer is disposed between said conductive layer and said elongate part; and structure that electrically couples said elongate part and said conductive layer at a third location, said second location being between said first and third locations in the direction lengthwise of said elongate part.

22. An apparatus according to claim 21, wherein between said first and second locations, said insulating layer has a thickness that is at least approximately 0.012 inches.

23. An apparatus according to claim 21, wherein between said first and second locations, said insulating layer has a thickness that is at least approximately 0.006 inches; and wherein said electrically conductive layer is said amorphous metal.

24. An apparatus according to claim 21, wherein said amorphous metal includes iron, chromium, silicon and boron.

25. An apparatus according to claim 21, wherein said insulating layer is sleevelike between said first and second locations.

26. An apparatus according to claim 25, wherein said conductive layer is sleevelike between said first and second locations.

27. An apparatus according to claim 25, wherein between said first and second locations:

said elongate part has a first surface portion that is approximately cylindrical and that engages said insulating layer; and said insulating layer is approximately cylindrical and has a second surface portion, said second surface portion being approximately cylindrical and engaging said conductive layer.

28. An apparatus according to claim 21, wherein said structure that electrically couples said elongate part and said conductive layer includes said conductive layer having a portion that engages said first surface portion at said third location.

* * * * *